US005263699A

United States Patent [19]

Selak et al.

[11] Patent Number: 5,263,699

[45] Date of Patent: Nov. 23, 1993

[54] SHEET FEEDER ALIGNING APPARATUS

[76] Inventors: Martin M. Selak, 512 Marina St., Mount Prospect, Ill. 60056; Vlado Radic, 1731 N. Elliott, Park Ridge, Ill. 60068

[21] Appl. No.: 892,566

[22] Filed: Jun. 3, 1992

[51] Int. Cl.[5] ..... B65H 5/08

[52] U.S. Cl. ..... 271/15; 271/105; 271/236; 271/250; 271/171

[58] Field of Search ..... 271/11, 13, 15, 105, 271/236, 250, 252, 248, 224, 171

[56] References Cited

U.S. PATENT DOCUMENTS

| | | | |
|---|---|---|---|
| 1,605,309 | 11/1926 | Waterworth | 271/20 |
| 2,087,437 | 7/1937 | Knight | 271/26 |
| 2,819,078 | 1/1958 | Durand | 271/39 |
| 3,411,640 | 11/1968 | Wallis | 214/8.5 |
| 3,724,687 | 4/1973 | Marschke et al. | 271/114 |
| 3,861,668 | 1/1975 | Wood | 271/105 X |
| 4,003,567 | 1/1977 | Berger, Jr. et al. | 271/12 |
| 4,027,872 | 6/1977 | Bucker | 271/170 |
| 4,148,473 | 4/1979 | Johnson | 271/20 |
| 4,189,138 | 8/1980 | Kaneko et al. | 271/109 |
| 4,570,757 | 2/1986 | Marzullo | 271/171 X |
| 4,588,183 | 5/1986 | Kitano | 271/236 |
| 4,591,143 | 5/1986 | Jeschke | 271/227 |
| 4,690,395 | 9/1987 | Nowicki | 271/105 X |
| 5,092,578 | 3/1992 | Bergmeier et al. | 271/105 X |
| 5,100,121 | 3/1992 | Takei et al. | 271/104 |
| 5,160,260 | 4/1992 | Obrecht | 271/105 X |

FOREIGN PATENT DOCUMENTS 0305745 12/1990 Japan ..... 271/248

*Primary Examiner*—H. Grant Skaggs
*Assistant Examiner*—Carol Lynn Druzbick
*Attorney, Agent, or Firm*—Wallenstein, Wagner & Hattis, Ltd.

[57] ABSTRACT

A side edge alignment system for pre-aligning side edges of sheet stock prior to feeding them into a printing press employs a sheet engaging vacuum suction member driven reciprocatingly across the feed path of the press. As the member travels towards a side alignment stop the engaged sheet is aligned upon engaging the stop. The suction level is adjustable so that the suction member disengages to slide over the top surface of the aligned sheet after engagement with the side alignment stop. Suction is terminated before the return stroke of the suction member. For stack feeding operations the side alignment stop is configured as a rail having planar upper and lower vertical wall surfaces, the upper being offset away from the suction member. Initial stack alignment is secured by lower elements of the stack engaging the lower face of the side alignment stop, leaving upper sheets at a standoff distance from the upper stop surface. Movement of the top sheet by the suction number causes it to move towards and into engagement with the upper surface of the side alignment stop.

23 Claims, 8 Drawing Sheets

Fig. 12
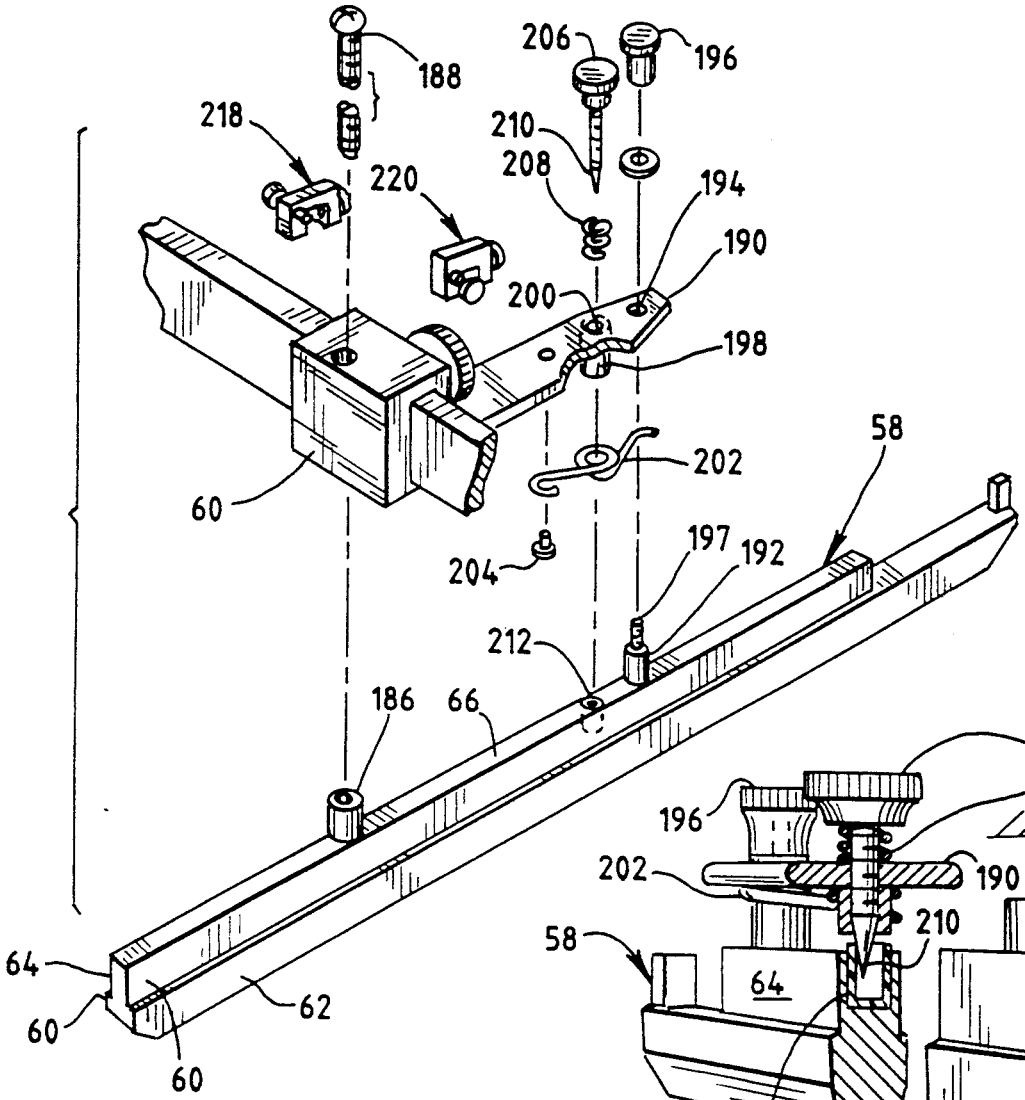
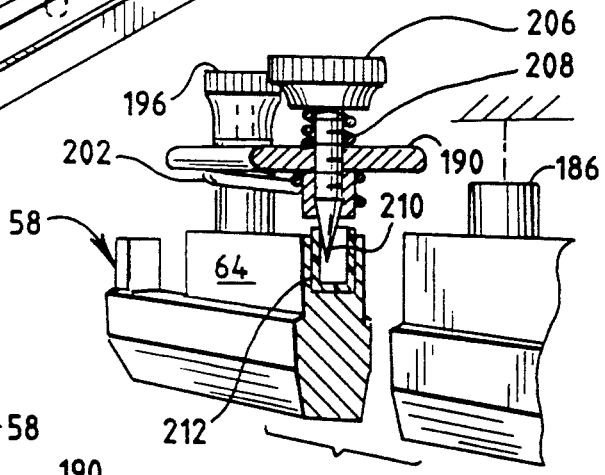
Fig. 13
Fig. 14
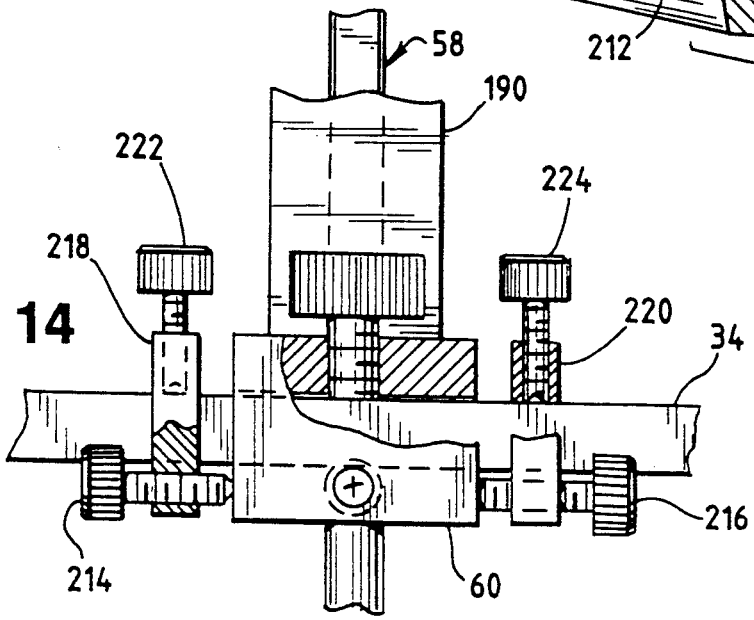

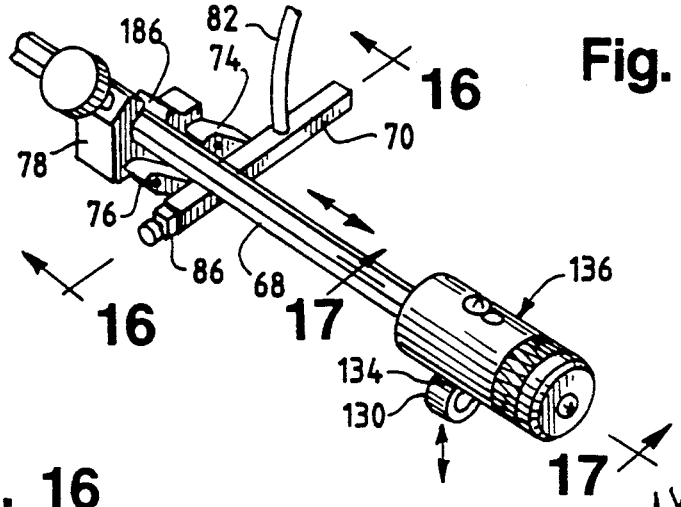
Fig. 15
Fig. 16
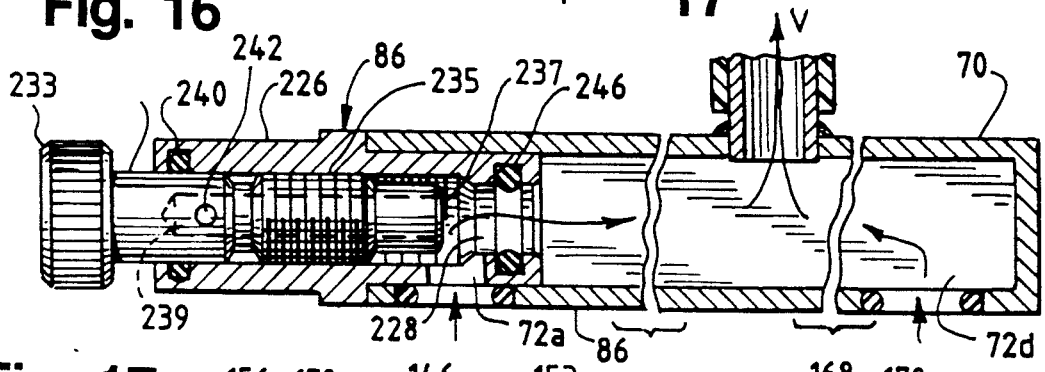
Fig. 17
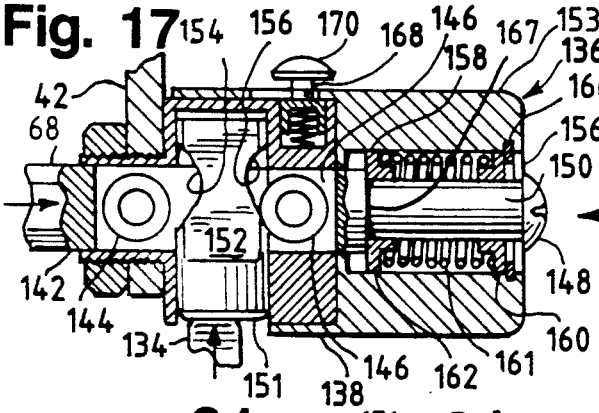
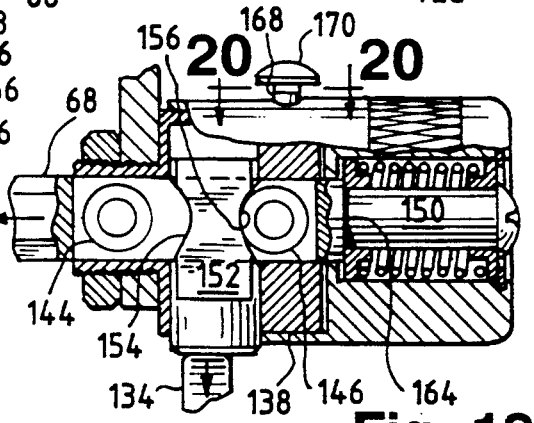
Fig. 18
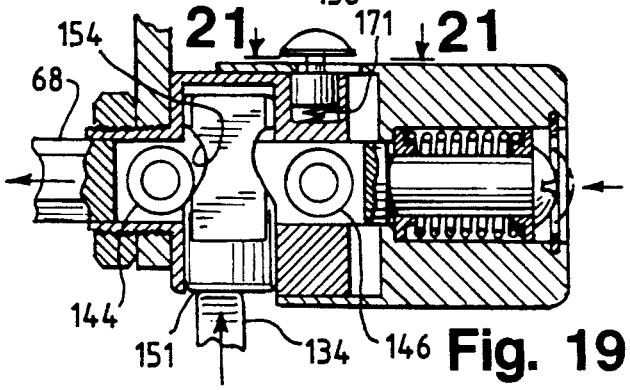
Fig. 19
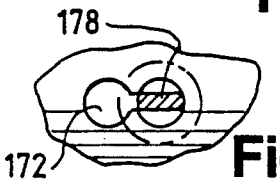
Fig. 20
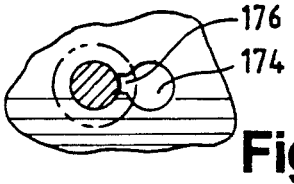
Fig. 21

Fig. 22
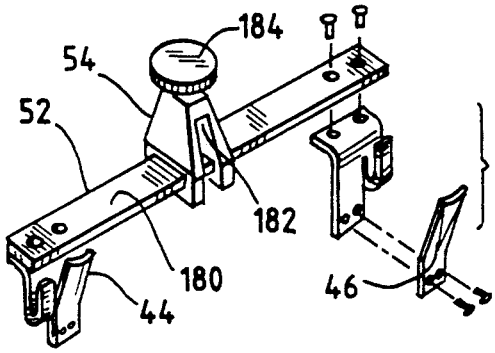
Fig. 23
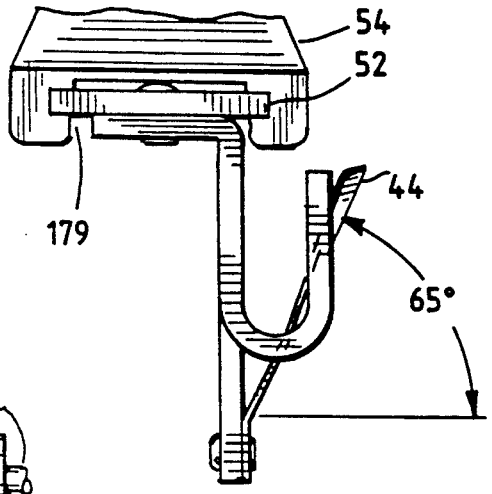
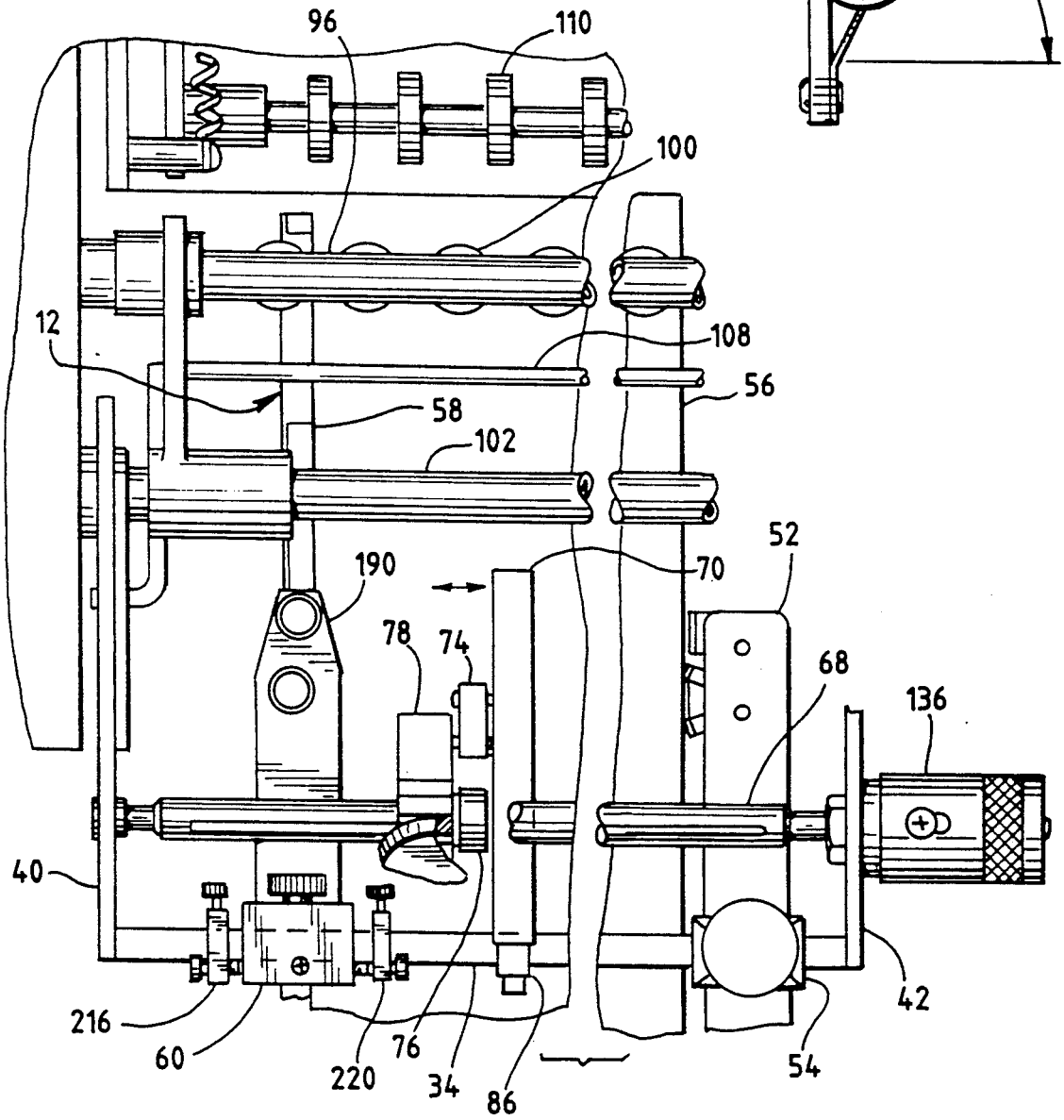
Fig. 24

SHEET FEEDER ALIGNING APPARATUS

TECHNICAL FIELD OF THE INVENTION

The technical field of the invention is the printing press art, and in particular systems for aligning and feeding sheet stock into a printing press for printing thereon.

BACKGROUND OF THE INVENTION

In the design of multi-color printing presses wherein the same sheet is fed a number of times into the press to achieve the desired coloring, it is well known that extremely precise front and lateral registry of the rectangular stock must be achieved and maintained with respect to the printing system prior to engagement with the printing elements. Additionally, when printing transparencies, stock pre-printed on one face must be turned over for one or more additional passes through the printing press. Here accurate front-to-rear registration is essential, again requiring suitable end and edge alignment systems.

Front end alignment is achieved in conventional printing presses by pressing the front edges of each sheet against a stop in the press. These commercial presses do not however generally provide a lateral edge alignment operation. Reliable side edge alignment, especially where lateral alignment is to be achieved of the upper most sheet in a stack of sheets, presents a difficult problem where it is desired to minimize costs in establishing such lateral edge alignment, and where both the cost of the press as well as that of the sheet feeding equipment and their reliability are paramount requirements in marketing the presses.

One procedure has been to mount the stack against a side alignment stop, typically configured in the form of a rail extending along the feed direction into the press. Sometimes the upper portion of a stack is spring urged against an edge alignment stop; however, consistently good side edge alignment is difficult to achieve in this manner, since erratic standoff distances are frequently encountered, commonly causing alignment errors of as much as 0.015" (0.28 millimeters). Other prior art alignment systems are either unreliable or too costly for applications where low cost is a paramount factor.

One prior lateral edge sheet alignment system (U.S. Pat. No. 2,819,078 to DuRand), uses a motor driven friction rotor disposed to engage the upper surface of the sheet and drive it sideways against a side alignment stop. One principal disadvantage of such a roller is that if it presses sufficiently hard to successfully move the sheet against the side alignment stop, a certain amount of scuffing occurs on the upper surface of the top sheet. This will frequently cause smearing of pre-printed inked areas as a result, and so this roller feed operation is not suitable for use with multi-color printing presses.

Another problem that such alignment systems must cope with arises from the fact that the corner angles of sheet stock as received from a manufacturer are seldom an exact 90°, and may in fact may vary from this by as much as 3°. In such cases if the edge alignment system aligns a given reference edge exactly perpendicular to, for example, the axis of rotation of the print and backing rollers in a rotary press, the leading edge of the sheet will be offset when intercepted by the stop in the press, and tilting of the sheet can result, causing color dot misalignment. This raises serious problems during two-sided printing operations, since reprinting a given sheet of stock on the reverse side using the same guide orientation will result in serious runout errors and general loss of color registry along the sheet.

There thus remains a need for an alignment system which will reliably and gently feed a top sheet of a stack against a side aligning stop without scuffing the surface of the paper. Additionally, there is a need for providing a side alignment stop which can accommodate the above mentioned errors in the corner angles of commercially available stock to allow accurate side alignment of the stock during reverse side printing operations.

One solution to some of the foregoing problems is shown in U.S. Pat. No. 4,591,143 (Jeschke). This patent shows a single sheet alignment system having end stops for securing leading edge alignment of an inserted sheet. A pair of motor driven vacuum platforms mounted in apertures in a sheet support platform drives a pair of vacuum chucks mounted for coaxial reciprocating movement beneath the lower surface of an emplaced sheet. The drive motors are stepping motors, and they are advanced initially in opposite directions to tension the leading edge of the sheet, whereupon they jointly proceed to move the sheet by increments until one edge is detected by an edge sensor. This terminates the alignment operation or initiates a fixed distance adjustment operation. The vacuum is released prior to pickup of the leading sheet edge by the feed mechanism of the press. The principal disadvantage of this system is that it is too expensive for many applications, in particular for low cost printing installations.

The instant invention is designed to solve these and related problems.

SUMMARY OF THE INVENTION

According to a feature of the invention, an alignment system for rectangular sheets of stock to be fed into a printing press includes a suction member having a sheet-engaging side provided with at least one suction aperture in communication with a source of vacuum. The suction member is carried by a motor-driven mounting system which supports the suction member for reciprocating driven motion in a direction having at least a component transverse to the direction the sheet is to be fed into the printing press (i.e., the insertion direction), and to position the sheet engaging side of the suction member in confronting sliding contact with one of the top and bottom surfaces of the sheet to be aligned. A side alignment stop is provided to align a side edge of the sheet to be parallel to the insertion direction when the sheet is placed against the stop by the suction member. The vacuum applied to the suction member is preferably adjusted to establish a sufficiently modest vacuum to allow the sheet to adhere to the suction member prior to engagement of the sheet with the side stop and to slide relative thereto when the sheet edge engages the stop to avoid buckling the sheet.

Thus, in contrast to the previously mentioned Jeschke patent, which requires a pair of step motors and associated vacuum holding elements to secure edge aligning motion of the sheet, and which further requires a sensor and control system to control the stepping motors, the present system achieves the same side aligning functions at greatly reduced cost.

According to a further specific feature of the invention, the suction member engages the top sheet in a stack of such sheets and the side stop is configured as an elongated member having a first vertical longitudinal surface confronting one edge of the stack of sheets and joining a similarly oriented outwardly offset second vertical longitudinal surface located above the first vertical surface to form a horizontal step extending away from the stack edge. A blower preferably separates the uppermost sheet lightly from the sheets on the stack below so that the suction member moves only the upper sheet in the stack against the outwardly offset vertical surface. In the preferred form of the invention the suction member drive system moves the suction member reciprocatingly only transversely to the insertion direction of the press. This minimizes the overall length of the alignment apparatus.

In the most preferred form of the invention, the suction member is a floating lightweight element resting on the upper surface of the sheet to be aligned and, except for the effect of the vacuum thereon, exerts very little pressure against the top sheet in the stack. Prior to the return stroke of the suction member, vacuum is terminated, and immediately thereafter a timing system causes the interior elements of the press to engage the forward edge of the sheet to feed the sheet into the press. Thus, the surface of the sheet is subject to minimal scuffing during the reciprocating motion of the suction member, and because vacuum is terminated during forward feed advance, there is no substantial rubbing contact then at all.

The exemplary form of the press, a modified commercial unit, employs a plurality of vacuum fingers to pick up the leading edge of the sheet, and a two-way suction valve is employed using the vacuum system of the press itself to selectively apply vacuum to the suction member or to the fingers. Vacuum to the suction member is turned off immediately prior to contacting of the sheet by the above mentioned fingers, which are concomitantly vacuum energized.

According to related features of the invention, the reciprocating motion of the suction member mounting system is achieved by a mechanical takeoff from the interior drive mechanism of the press to impart a reciprocating motion to the suction member mounting means properly synchronized with the movement of the vacuum fingers of the interior feed system. A single electrical switch actuated by this mechanical drive system governs the changeover time of the valving system.

According to a further feature of the invention the system is reconfigurable so that the side alignment stop may be placed to guide either side edge of a sheet, and the mounting system for the suction member is adjustable for a right-to-left or left-to-right stroke so that the stop can be mounted on one side or the other of the feed path. To this end, the side alignment stop is provided with a pair of alignment edges on either side, each side having an offset step.

Vernier means are provided for precise adjustment of the position of the side alignment stop with respect to the chosen edge to be aligned, and a vernier rotation system allows the side alignment stop to be moved through a range of angular positions spanning several degrees on either side of the insertion axis of the press.

Other features and advantages of the invention will be apparent from the following specification taken in conjunction with the following drawings.

DESCRIPTION OF DRAWINGS

FIG. 12 is an exploded view of an adjustable side alignment stop.

FIG. 13 is a partially cutaway view of a portion of the side alignment stop shown in FIG. 12.

FIG. 14 is a partial cross section view of a vernier adjustment system for adjusting the lateral position of the stop shown in FIG. 12.

FIG. 15 is a perspective view showing elements of a reciprocating suction system for moving sheets into side edge alignment.

FIG. 16 is a cross section of a vacuum regulator valve associated with the suction system of FIG. 15.

FIGS. 17–19 are cross section views of a phase reversing coupling unit used to convert the printing press of FIG. 1 from a right edge alignment system to a left edge alignment system.

FIGS. 20 and 21 shown a lock associated with the coupling unit shown in FIGS. 17 and 18 in two drive configurations.

FIG. 22 is perspective view of a resilient biasing system for urging a stack of printing stock sideways.

FIG. 23 is a partial detail view of one of the resilient biasing elements shown in FIG. 22.

FIG. 24 is a broken partial plan view of the printing press shown in FIGS. 1 and 2 reconfigured for left hand edge sheet alignment.

DESCRIPTION OF INVENTION

Figure 1:
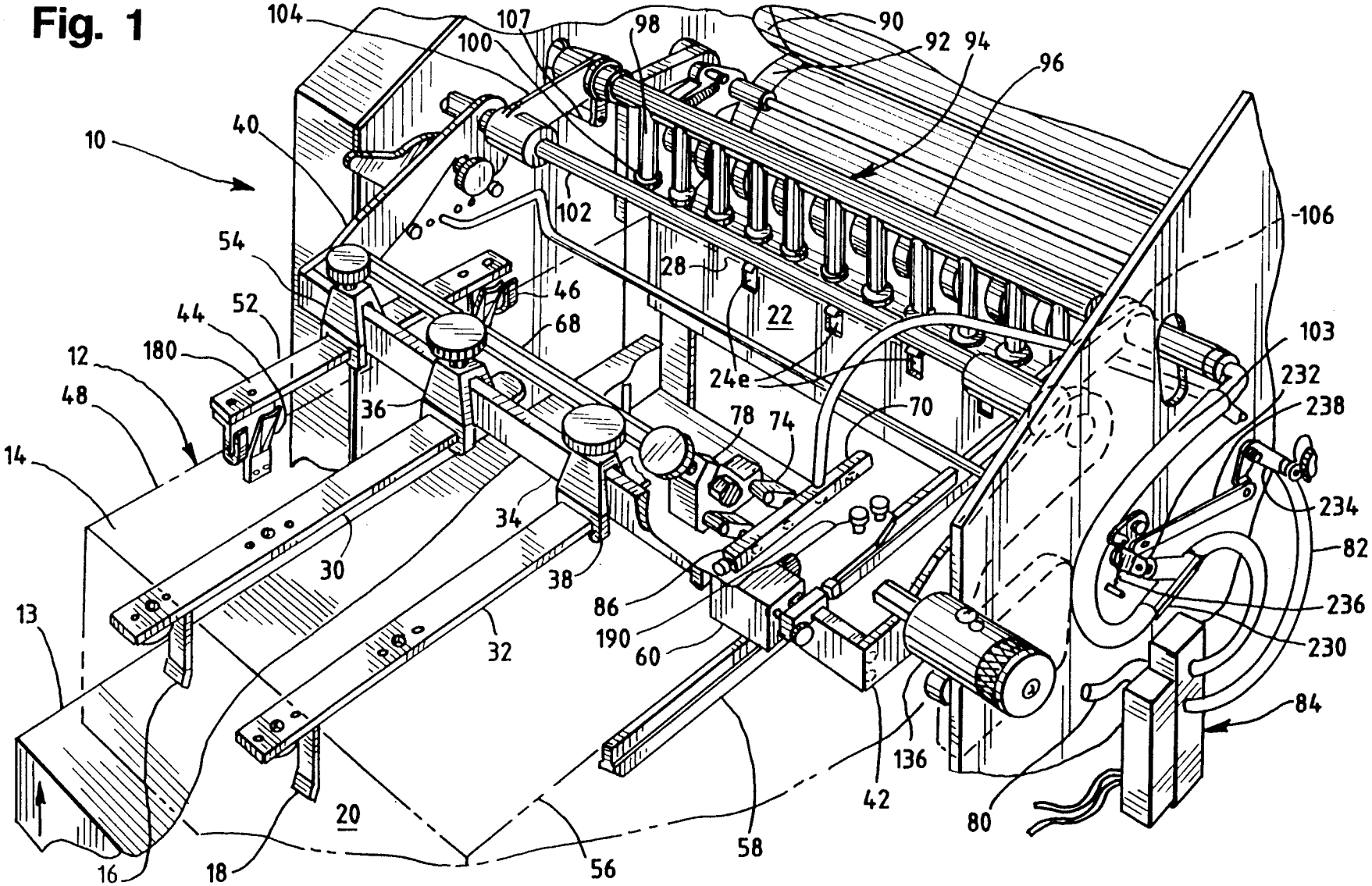
FIG. 1 is a perspective view of a commercially available printing press modified according to the present invention.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

Referring now to the drawings and in particular initially to FIGS. 1. 2 and 2A, a modified commercially available printing press 10 (Model 9870, made by A. B. Dick Company of Niles, Ill., and described in their Service Manual No. 176,330, Copyright Apr. 28, 1989), is shown. The printing press 10 has been modified to provide precise edge alignment of printing stock dispensed from a stack 12 resting on a support platform 13. Where existing elements of the commercially available press have been modified, or where new elements have been added, mention will be made at appropriate points in the following text.

A pair of resilient forward bias elements 16,18 engage a number of the uppermost sheets at a rear portion 20 of the stack 12 to force then forward into arresting engagement with a planar front end rough alignment stop 22 generally configured as a plate. The forward bias elements 16,18 are carried respectively on carriage bars 30,32, the bars in turn being secured to a transverse bar 34 by means of releasable slidable clamps 36,38. The transverse bar 34 and all elements mounted thereto represent modifications of the existing machine. The transverse bar 34 in turn is affixed to the outer ends of pivotally mounted carriage plates 40,42, these plates being standard on the machine as manufactured.

Figure 2:
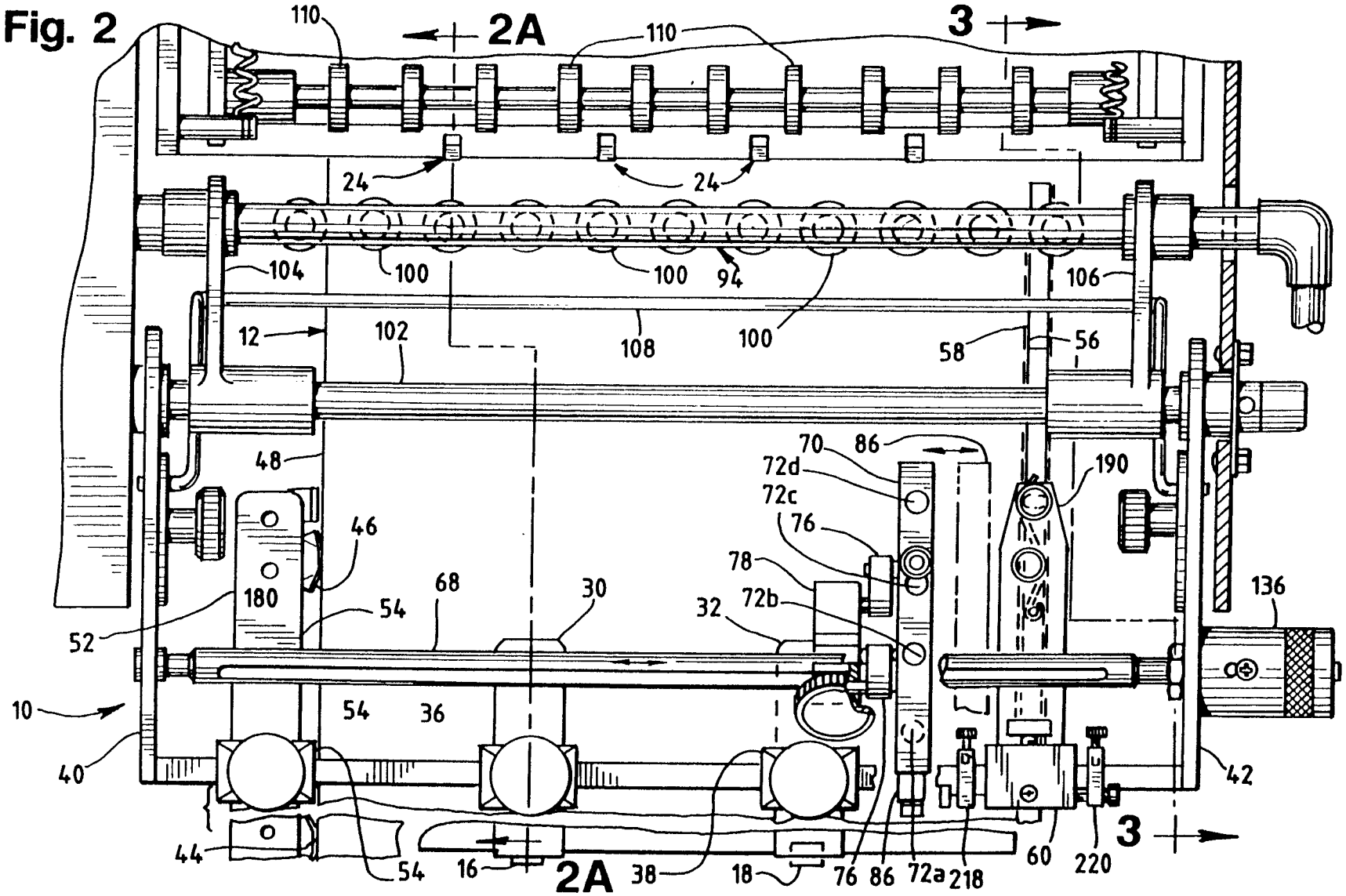
FIG. 2 is a partial top view of the printing press shown in FIG. 1.
Figure 2A:
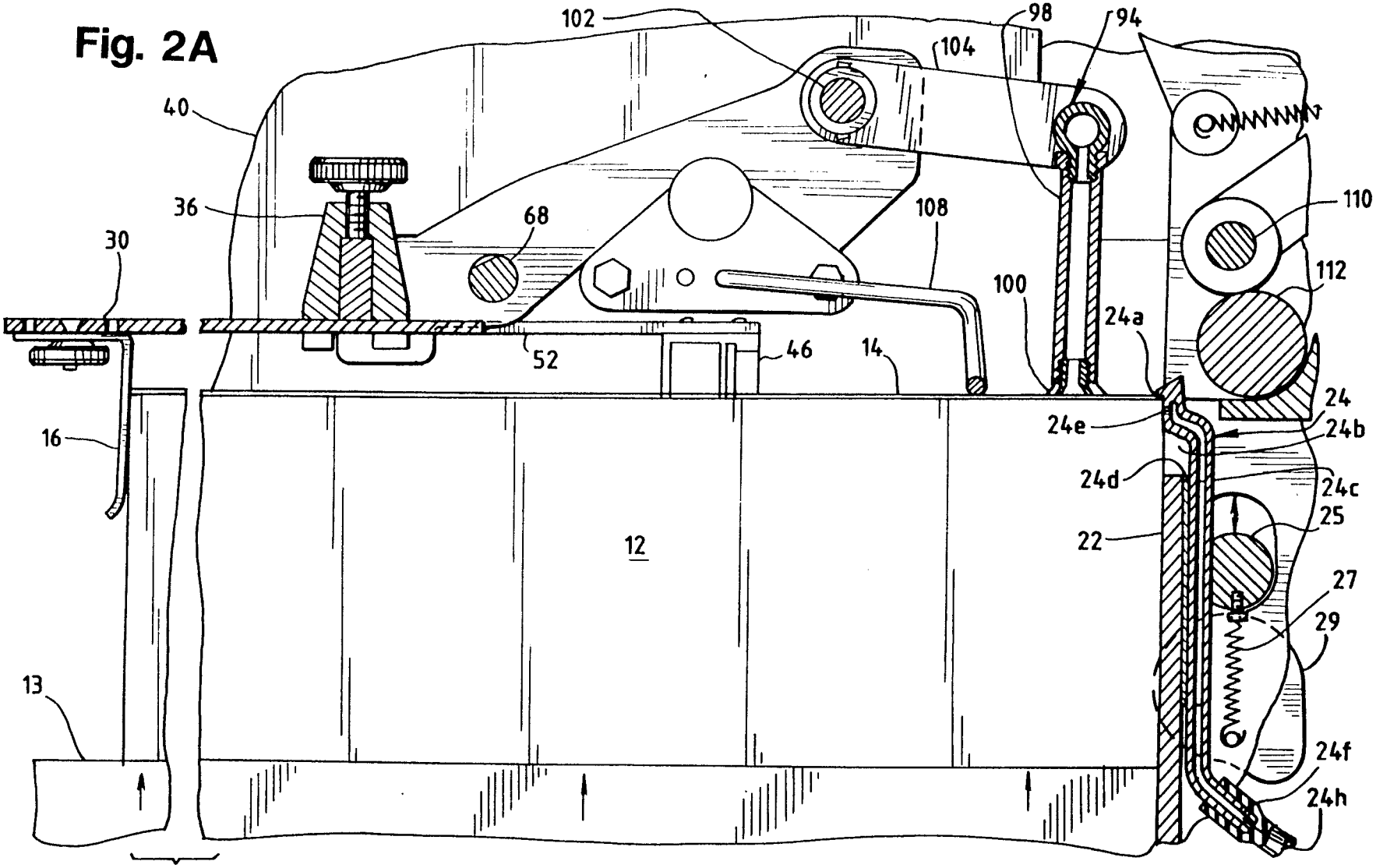
FIG. 2A is a cut away cross section view taken along lines 2A—2A of FIG. 2.

Referring in particular to FIG. 2A, during feed operations the stack 12 is raised upward by raising the support platform 13 by conventional means (not shown). Accurate indexing of the height of the stack is achieved by means of four hook assemblies 24 having at their upper ends hook projections 24*a* extending through respective apertures 24*b* in the front end rough alignment stop 22. Each hook assembly 24 includes a shank portion 24*c* slidably secured within a vertical guide channel 24*d* affixed to the rear surface of the alignment plate 22. The shank 24*c* of the hook assembly 24 is hollow, having a passage 24*e* extending axially there along and communicating at its upper end with an outlet orifice 24*h*. A lower end of 24*f* of the hook assembly is in communication with a timed pressurized source of air (not shown). The four hook assemblies 24—24 are affixedly secured to a transverse rod 25 downwardly biased by a spring 27 against a cam 29. Rotation of the cam 29 will cause the hook assemblies 24—24 to rise and fall in unison. Raising the support platform 13 to optimum height will cause the top most sheet 14 of the stack 20 to engage the projections 24*a*, moving the hook assemblies 24—24 upward, and moving the transverse rod 25 out of contact with the cam 29. Optimum height is established by a sensor (not shown) which senses the height of the transverse bar 25 to terminate lifting of the support platform 13. The height of the stack is continuously adjusted during feed operations to maintain the topmost sheet 14 at optimum height.

A sideways thrust urging the uppermost sheets of the stack 12 to the right (as seen in FIG. 2) is provided by a pair of resilient side biasing elements 44,46 bearing against uppermost sheets at the left edge 48 of the stack 72. The biasing elements 44,46 are carried at the ends of a carriage bar 52 secured to the transverse bar 34 by means of a slidable clamp 54. The uppermost sheets of the right stack edge 56 are brought into engagement with portions of an elongated side alignment stop 58 aligned along the feed direction of the press and mounted to the transverse bar 34 by means of a slidable clamp 60.

Referring in particular to FIG. 12, it will be noticed that the side alignment stop 58 is characterized by parallel vertical planar lower faces 60–62 on either side, each of the lower faces 60,62 terminating at their upper edges in inwardly offset parallel upper faces 64,66. The offset is approximately 0.027 inches (0.066 millimeters). The side thrust exerted by the left side biasing elements 44,46 (FIGS. 1,2) is such that a number of sheets in the stack 12 will be brought into arresting engagement with the lower face 60. A final precise alignment is secured by means of a vacuum shifting system operating solely on the topmost sheet 14 of the stack 12 (FIG. 1), which will be discussed next.

A transversely extending shifting rod 68 is mounted for axial reciprocation through the carriage plates 40,42. As will subsequently be discussed, this rod is driven synchronously in axial reciprocation by the motor drive system 69 (FIG. 3) of the printing press. A generally elongated suction member 70 configured as a hollow chamber having a plurality of apertures 72*a*–72*d* on a lower face thereof is mounted by a pair of parallel links 74,76 each pivotally attached its lower end to a common side of the suction box 70. Their upper ends are similarly pivotally attached to a slidable clamp 78 affixed to the shifting rod 68.

The suction chamber 70 is evacuated by means of a vacuum pump (not shown) associated with the printing press 10 and communicating with the suction chamber 70 through vacuum conduits 80,82. An electrically operated valve 84 interposed between conduits 80,82 applies vacuum to the suction member 70 at the beginning at each stroke of the shifting rod 68 towards the carriage plate 42 (i.e., to the right as seen in FIG. 1.

The terminal right-most extent of travel of the suction member 70 is shown by the dotted outlines 86 in FIG. 2. Vacuum release is secured by operating valve 84 to a cutoff condition, whereupon the air enters the suction member 70 through a bleed valve 86, and suction is thus removed from the suction box 70 during leftward movement of the suction member 70. The shifting rod 68 and all elements mounted thereon and associated therewith are new with respect to the standard factory model of the AB Dick printing press.

Figure 6:
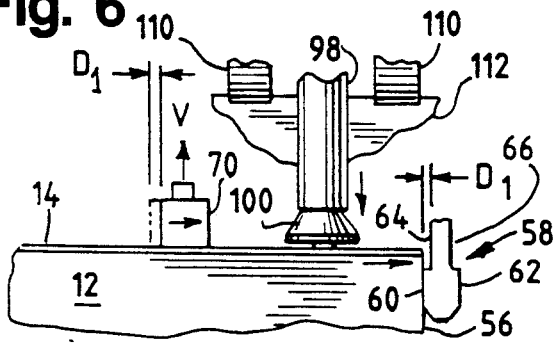

The configuration of the forward bias elements 16,18 and the generally planar rough alignment end stop 22 allow the topmost sheet 14 to be slid to the right. Thus, since the suction member 70 is supplied with vacuum at the beginning at its right ward stroke, the upper surface of the topmost sheet 14 in the stack is adheringly secured to the lower face 87 of the suction member 70 during initial phases of the rightward movement. The topmost sheet 14 is thus slid to the right until its right edge 88 comes into contact with the upper face 64 of the side alignment stop 58. This condition is shown in FIG. 6. Once this engagement has occurred the topmost sheet 14 is properly aligned and ready to be fed into the interior of the press 10 for the printing operation.

Figure 8:
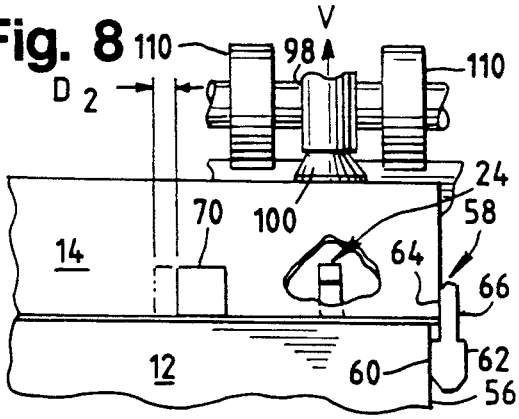

The necessary degree of vacuum to be supplied to the suction member 70 will vary according to the thickness, and thus the weight, of the particular printing stock used. This level is regulated by the setting of a bleed valve 86. By proper setting of the bleed valve 86 the suction member 70 will continue to the end of its stroke to the right as shown in FIG. 8; however, the vacuum level is such that the suction member 70 merely slides along the top surface after the stop 58 has been engaged. Experience has shown that by establishing a proper level vacuum in the suction member 70, and by keeping the overall weight of the suction member 70 and the links 74,76 sufficiently low, the suction member 70 can successfully move the topmost sheet 14 into aligning engagement with the side alignment stop 58 without buckling the stock, and at the same time during the sliding movement thereafter causes no scuffing of the paper or smearing of inked indicia already present on the topmost sheet 14 from a prior pass through the printing press. The accuracy of alignment of the system described has been measured by observing the registration accuracy of patterns produced by multiple printing passes on the same sheet of stock. The maximum registration error is approximately ±0.001 inches (0.025–0.026 millimeters).

FIGS. 4–11 illustrate the various phases of the feeding and alignment cycle. Certain components have been removed for clarity. Referring first back to FIGS. 1, 2 and 2A between a print roller 90 and an associated backing roller 92 a vacuum manifold 94 is disposed. The vacuum manifold comprises a horizontally extending main conduit 96 in communication with a plurality of parallel downwardly extending vacuum fingers 98. Each of the fingers 98 terminates in an elastomeric hollow end flange 100. The vacuum is selectively applied to one end of the main conduit 96 through a vacuum line communicating with the valve 84. Actuation of the valve 84 applies a suction to the main conduit 96 and through the vacuum fingers 98 to the end flanges 100. The valve 84 is chosen as a two-way valve, i.e., suction is either applied to the vacuum manifold 94, or alternatively to the suction member 70.

A transversely extending drive shaft 102 is mounted for rotation at both ends to the carriage plates 40,42. Interior mechanisms of the motor drive system (not shown) of the printing press causes a timed oscillating rotation of the drive shaft 102 over a limited angular displacement. The ends of the main conduit 96 are rotatably mounted to the outer ends of extension links 104,106, the other ends of these links being rigidly affixed to the ends of the drive shaft 102. Rotation of the drive shaft 102 thus causes the vacuum fingers 98 to be alternately raised and lowered. The interior drive system of the printing press 10 is also coupled to impart the additional rotary motion to the main conduit 96 by means of a coupling arm 107. A bail 108 extending between the two carriage plates 40,42 is also pivotally mounted for motor driven rotation through a limited degree, thereby raising and lowering the bail 108 in synchronism with the other moving elements of the printing press.

Figure 4:
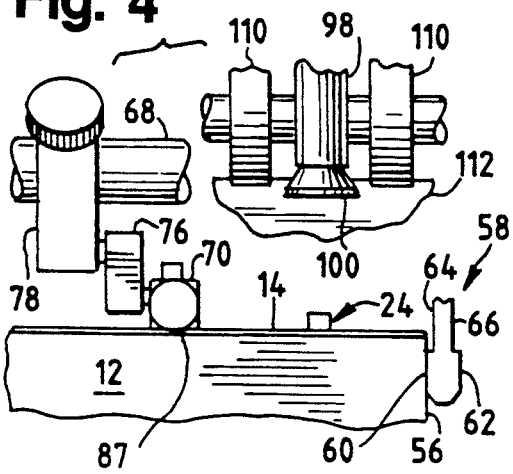
FIGS. 4–11 show sequential phases of feeding print stock from a stack into the interior system of the printing press shown in FIG. 1.
Figure 5:
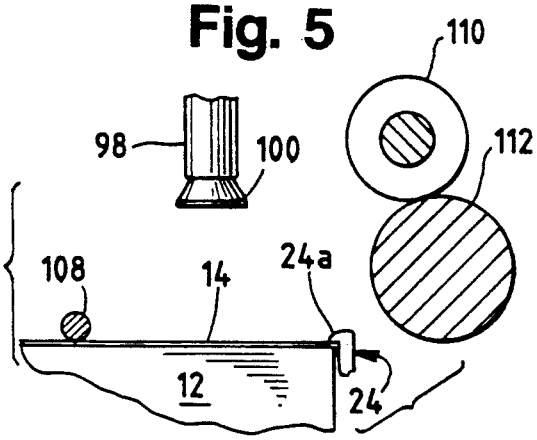

Considering now the synchronization of elements during a feed cycle, FIG. 4 shows the system with the suction member 70 at its extreme left-most position with the vacuum fingers 98 at a standoff distance from the upper surface of the topmost sheet 14. The bail 108 is in its maximum downward position at this time as shown in FIG. 5. The finger hooks **24*a* are engaging the leading edge 28 of the topmost sheet 14**.

Figure 7:
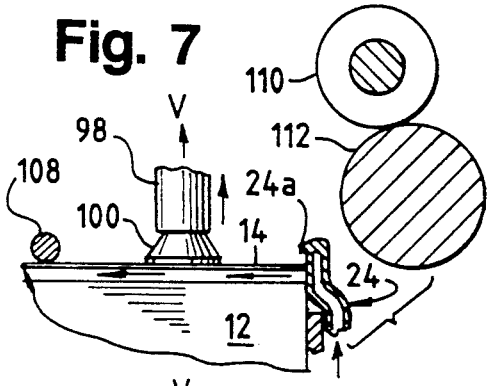

FIG. 6 shows the next stage of the printing cycle. The hook assemblies 24 have been raised so that the hook projections **24*a* are out of contact with the topmost sheet 14. The suction member 70 is now moved to the right a distance $D_1$ to move the edge of the topmost sheet 14 into aligning contact with the upper surface 64 of the side alignment stop 58. The vacuum fingers 98 at this time are closely approaching the topmost sheet 14. Slightly later in time the suction member 70 has moved to its extreme right most limit a distance $D_2$ (see FIG. 8), whereupon vacuum is switched by valve 84 (by means to be discussed) to terminate suction to the suction member and apply it to the vacuum fingers 98. FIG. 7 shows a later phase in the operation, the suction fingers 98 having been brought into contact with the topmost sheet 14, and the fingers 98 and the bail 108 are now rising. The hook assemblies 24 have been extended upward sufficiently to position their orifices 24*e* (see FIG. 2A) to blow a stream of air at the leading edge of the topmost sheet 14** to ensure that lower sheets do not adhere to it.

Figure 9:
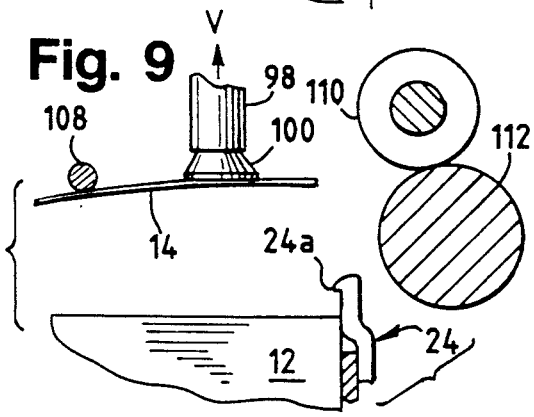

FIGS. 8 and 9 show a later phase in the cycle showing the now de-energized suction member 70 at its right-most limit of travel, the energized vacuum fingers drawing the topmost sheet 14 free of the stack 12, and the bail 108 following along upward with the vacuum fingers 98.

Figure 10:
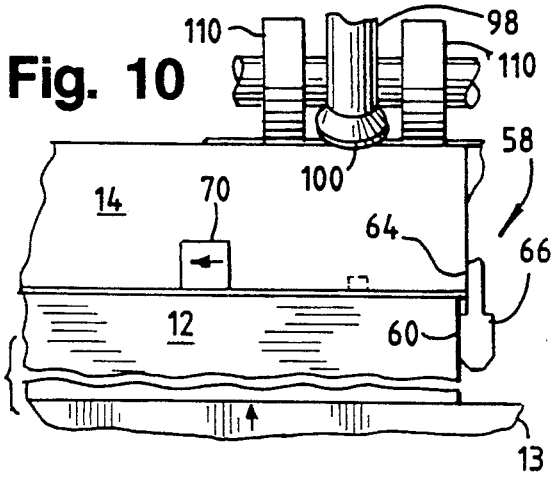
Figure 11:
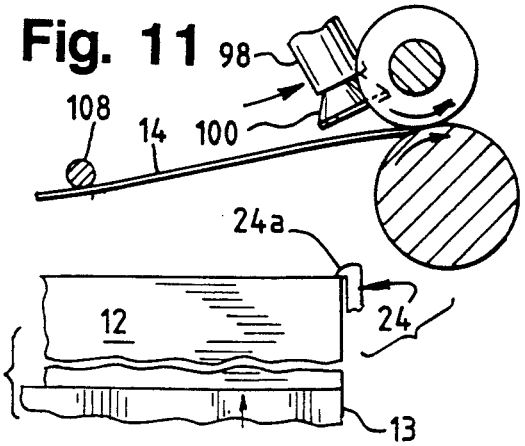

FIGS. 10 and 11 show a later phase in the cycle wherein the suction member 70 has travelled well to the left, the topmost sheet 14 has been advanced sufficiently to be engaged by motor driven nip rollers 110,112, and the de-energized vacuum fingers 98 have been rotated to be out of contact therewith. Subsequently the mechanisms reposition themselves as shown in FIGS. 4 and 5 to initiate operations on the next piece of stock. FIGS. 5, 7, 9 and 11 show features of the unmodified AB Dick machine and are included f or purposes of clarity only.

An accurately timed release of vacuum from the vacuum fingers is secured as follows. Referring to FIG. 1, line 103 communicating between the vacuum manifold 94 and the valve 84 has interposed therein a Y-fitting 230. A spring loaded poppet valve element 232 confronts one end of a side tubulation 234 of the Y-fitting 230. The poppet element 232 is configured so that a spring 236 urges the element to a closed condition against the end of the tubulation 234. A reciprocating arm 238 synchronously driven by the rotary press drive mechanism (not shown) extends to drive the poppet valve element 232 to an open condition immediately before engagement of the sheet 14 by the pinch rollers 110, 112 as shown in FIG. 11. This allows air to enter the vacuum manifold 94 to release the vacuum condition therein. Shortly thereafter the poppet element 232 is returned to its sealing condition against the end of the tubulation 234.

Final capture of the sheet 14 is secured as follows. Referring again to FIG. 3, a recess 239 is provided in the surface of the backing roller 92. A number of gripping fingers 240 are deployed at a distance from a capture surface 241 adjacent the recess 239. These fingers 240 are deployed to the position shown by interior synchronously driven mechanisms of the press. Carried along with the gripping fingers 240 are a number of terminal end registry stops 242 having stop ends 244 at right angles thereto. The pinch rollers 110,112 propel the sheet 14 into a bowing engagement with the stop ends 244. The gripping fingers 240 and the terminal end registry stops 242 are then retracted downward so that the gripping fingers 240 capture the leading edge of the sheet 14 against the capture surface 241, and the terminal end registry stop is retracted further into the recess 239. This serves to provide final and accurate end registration of the work sheet 14.

Figure 3:
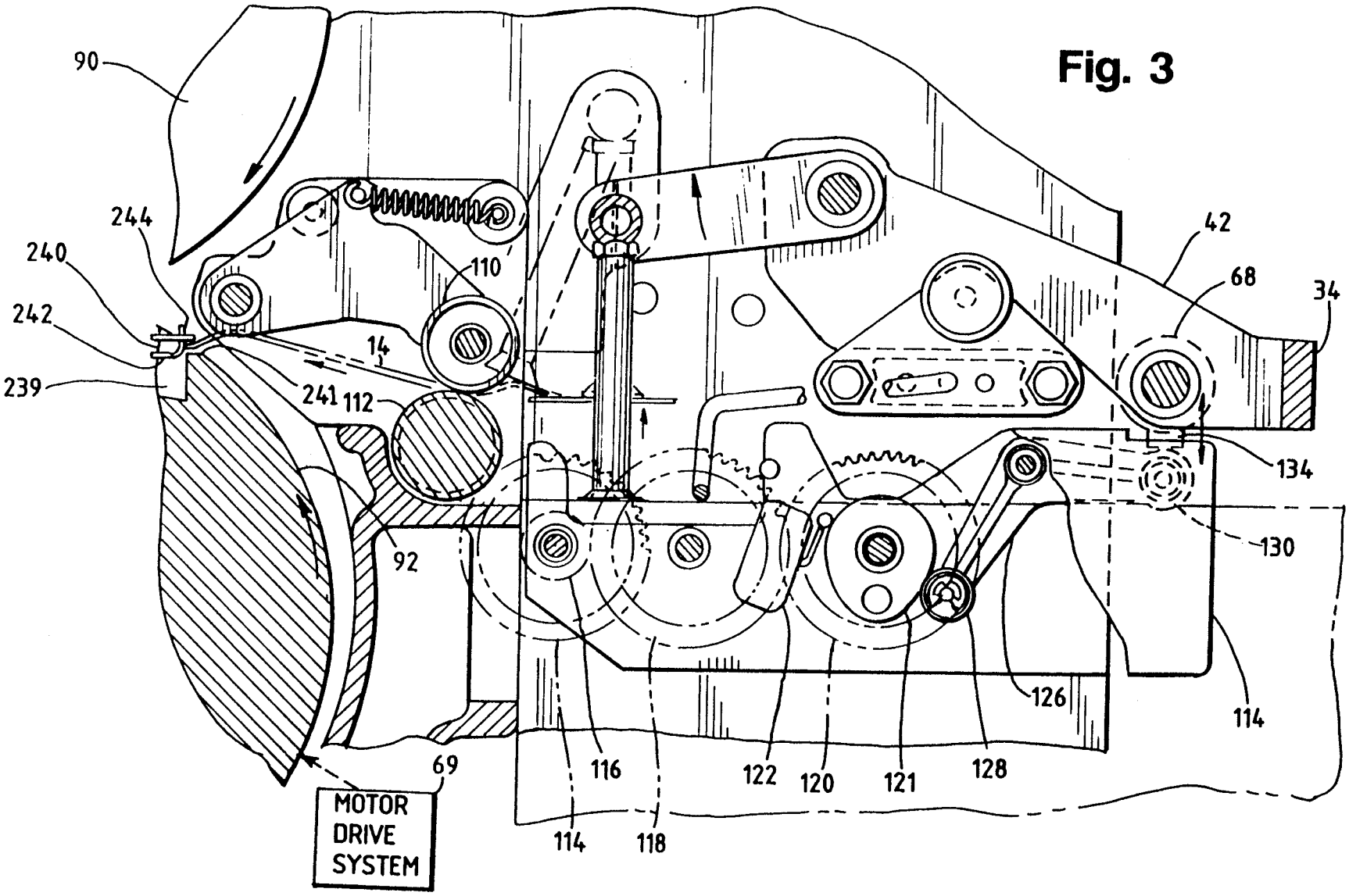
FIG. 3 is a cut away cross section view of an accessory of drive drain for a paper stock feeding system taken along lines 3—3 of FIG. 2.

Considering next details of the synchronization of the various feed systems, FIG. 3 shows principal drive elements of the AB Dick press as modified. In addition to previously mentioned modifications, additional drive and synchronization elements are mounted to an accessory mounting plate 114. The lower nip roller 112 of FIG. 5 is provided with a gear thereon driven by the motor drive system. This gear (not shown in the drawings) is meshingly engaged to drive a gear train comprising gears 114,116,118,120. The final driven gear 120 has on one face thereof a cam 121, and a micro switch 122 is provided positioned so that its actuating arm 124 is in contact with the cam.

A rocker arm is rotatably mounted to the mounting plate 114, and has a roller at one end engaging the cam 121, and a roller 130 at its opposite end. Rotation of the gear train 114–120 responsively to rotation of the nip roller 112 will thus cause the rocker arm 126 to oscillate. In particular, this will cause the roller 130 to oscillate up and down, driving a tappet 134 to execute a vertical reciprocating movement. It is this vertical reciprocating movement that causes the reciprocating transverse movement of the shifting rod 68 (FIG. 1,2) as will be discussed next.

Referring now in particular to FIGS. 15, 17–21, a coupling unit 136 is provided which converts the vertical reciprocating motion of the roller 130 and the tappet 134 into an axial transverse reciprocating motion of the shifting rod 68. The coupling unit 136 includes a cylindrical body portion 138 having an axially extending end bushing threadingly secured through the carriage plate 42. A passage 142 extending centrally through the body 138 accommodates the end portion of the shifting rod 68. Affixed to the end portion of the shifting rod 68 and separated at a distance from each other are a pair of cam follower rollers 144,146 rotatable about axes transverse to the reciprocation axis of the tappet 134. An axial screw 148 is threadingly attached to the end of the shifting rod 68 through a sleeve 150. The screw 148, the sleeve 150, the follower rollers 144,146, and the shifting rod 68 are all coupled together and move as an integral unit. A vertical passage 151 is provided at the left hand end of the body 138 and accommodates a movable piston 152 having a pair of cam surfaces 154,156 confronting the cam follower rollers 144,146 respectively. The piston 152 is moved up and down responsively to movement by the tappet 134 engaging the piston 152.

A spring biasing system is provided for providing a spring bias urging the shifting arm 68 either constantly to the right, or constantly to the left. As will be discussed, the direction of this spring bias will govern whether the shifting rod 68 moves to the right responsively to an upward movement of the tappet 134, or in the alternative to the left responsively to the same motion. As will subsequently be discussed, this phase changing capability is particularly useful in reconfiguring the alignment system to shift the top sheet in the opposite direction to that shown in FIG. 6, so as to secure alternative registry using the left stock edge 48.

To bias the shifting rod 68 in a given direction, a cylindrical shell 153 is coaxially disposed on the body portion 138 to be axially slidable with respect thereto. A latching system to be described subsequently allows the shell to be locked in a leftward position shown in FIGS. 17 and 18, or in a rightward position as shown in FIG. 19. The shell 153 has ân axially extending end passage 156 which accommodates the screw 148. The inner end of the passage 156 terminates in a shoulder 158. A helical spring 161 is concentrically disposed about the sleeve 158 and is held captive at its ends by movable ferrules 160,162. The spring is dimensioned to be normally in a compressed state, and the right-most ferrule 160 is arrested by engagement with the head of the screw 148. Leftward movement of the ferrule 162 is terminated according to whether the ferrule 162 engages the shoulder 158 of the shell 153, or the end face 164 of the shifting rod 68. A snap ring 166 is disposed at the outer end of the sleeve passage 156 and is configured to engage the ferrule 160 under certain circumstances.

With the shell locked in its left-most position as shown in FIGS. 17 and 18, the shoulder region 158 is to the left of the shifting rod end face 164. The compressed spring 160 also forces the ferrule 162 against the rod end 167. The compressed spring forces the ferrule 160 against the snap ring 166 to be captively held thereby. Thus, the shifting rod 68 is under constant spring bias to the left. This forces the cam follower 146 into contact with the cam surface 156. An upward movement of the tappet 134 thus causes a rightward movement of the shifting rod 68. When the tappet 134 drops as shown in FIG. 18, the spring-urged cam follower 146 is then allowed to move to the left, carrying the shifting rod 68 in that direction also.

The alternative configuration is shown in FIG. 19. Here the sleeve 153 is extended to the right. In this configuration the compressed spring now urges the ferrule 162 against the shoulder 158, and the reflected force of the spring 160 now causes the ferrule 160 to be urged against the head of the screw 148, thereby imparting a rightward spring tension on the shifting rod 68. The action is now reversed, and cam follower 144 is urged into engagement with cam surface 154. Now upward movement of the tappet 134 will cause the cam follower 144, and hence the shifting rod 68 to the left. Thus, the position of the shell 153 is used to reverse the phase of the reciprocation of the shifting rod 68 with respect to remainder of the mechanical system governing the operation of the printing press 10.

Stable latching of the shell 153 in the two positions shown is achieved by means of a spring loaded latch comprising a radially extending shank 168 surmounted by a button 170. The shank resides in a radially disposed well in the shell 153 and is urged outward by a spring 171. The shank extends alternatively through one of two holes 172,174 in the outer wall of the shell 153, the holes being joined by a channel 176 as shown in FIGS. 20 and 21. The shank 168 has a narrowed portion 178 immediately below the button 170. When the button 170 is depressed the narrowed portion 178 allows the shell 154 to be moved to either of the configurations shown in FIGS. 20 and 21. Release of pressure on the button allows the spring 172 to force the wider portion of the shank 168 into the chosen one of the two holes 172,174, thereby locking the shell 153 in the chosen position.

In multi-color printing operations on transparent stock it is frequently necessary to print on both sides of a given sheet in different colors. Thus, proper registration must be maintained for such operations. A serious difficulty arises in that the parallelism of opposite edges of commercially available stock is sufficiently variable that one is forced to use the same edge of the stock as an alignment guide during both phases of such two-sided printing operations. To accomplish this the system as previously described is reconfigurable to permit leftward shifting of the topmost sheet 14 against a side alignment stop placed along the left side of the feed path. Such a reconfigured state of affairs is shown in FIG. 24.

This reconfigurration is possible because of the nature of the various clamps used to position elements of the system. Thus, referring in particular to FIGS. 22 and 23 showing details of the side biasing element comprising resilient elements 44,46 carried on carriage bar 52 and attached to the transverse bar 34 by means of a clamp 54, it will be noted in FIG. 23 that the carriage bar 52 is captively retained within an open bottom channel 179. Clamp 54 is open at the bottom of the passage 182 to allow its complete disengagement from the transverse bar 34 upon removal of carriage bar 52. Tightening a mounting screw 184 thus serves to secure the clamp 54, the transverse bar 34, and the carrier bar 52 together. Loosening of the screw 184 allows the carrier bar 52 to be completely withdrawn and the clamp 54 removed if desired. Clamps 36 and 38 are similarly configured, so that bars 30 and 32 may also be interchanged the to permit the reconfigurration of the system for leftward shifting. The suction member clamp 178 is a c-clamp having a passage 186 therein which allows the entire assembly to be removed and repositioned to be reinstalled at the left hand side of the system as shown in FIG. 24. With the remaining clamps removed from the transverse bar 34, the alignment bar clamp 60 may be loosened and slid to the left to take the position indicated in FIG. 24.

The phase reversing function of the coupling unit 136 allows the use of the original timing system without change. In particular, the micro switch 122 (FIG. 3) which governs the changeover point of the valve 84 need not be readjusted. The entire running cycle will proceed as previously described, except that vacuum will be selectively applied to the suction member 70 during its travel towards the left stock edge 48.

Two problems remain to be addressed. One is the precise positioning of the side alignment stop 58, and the other arises from the fact that the angle between the leading edge and a given set of side edges of a stack of stock is seldom exactly 90°. It can vary by as much as 3°; however, the errors tend to be identical within a given ream of stock. Thus, in addition to establishing a precise lateral position of the alignment stop 58, it must be adjustable in angle as well so as to deviate slightly from the feed path in order to accommodate non-rectangular corner angles of the stock. The details of how this is accomplished are shown principally in FIGS. 12–14.

The side alignment stop 58 is pivotally mounted to the clamp 60 by means of a post 186 extending upward from the stop 58 and rotatingly secured to the clamps 60 by means of a screw 188. Affixed to the clamp 60, and extending along the feed direction of the printing press 10 is a support plate 190. A forward post 192 is mounted to extend from the top of the side alignment stop 58 and to pass through an elongated hold 194 near the outer end of the support plate 190. The side alignment stop 58 may thus be rotated a limited degree about the post 186. It may be locked at a chosen angle by means of a nut 196 affixable to a threaded extension 197 extending from the forward post 192. Fine adjustment of the angle prior to such locking is achieved as follows.

A threaded bushing 198 is affixed to the support plate 190, the interior of the bushing being aligned in prolongation of a hole 200 in the support plate 190. A wrap around spring 202 is centered on the bushing 198 and has one end secured to the lower face of the support plate 90 by a screw 204. The other end of the spring 202 bears against the forward post 192 to urge the side alignment stop 58 into clockwise rotation as seen in FIG. 12.

The threaded bushing 198 is offset with respect to a line joining the center of pivoting of the post 188 and the center of the elongated hole 194. Angular adjustment of the orientation of the side alignment stop 58 is achieved by means of a vernier adjustment screw 206 threadingly inserted into the bushing 198 through a helical friction spring 208. The lower end 210 of the adjustment screw 206 is configured as a tapered point. A bushing 212 is inserted into the top surface of the side alignment stop to form a downwardly extending well. This bushing 212 is centered on the line of centers between the post 186 and the post 192. With the alignment assembly completed as shown in FIG. 13, it will be noted that, because of the clockwise urging of the spring 202 and the offset nature of the vernier screw 206, that the lower end 210 of the screw will bear on the left hand side of the interior of the bushing 12. Thus, advancing the vernier screw 206 downward will impart a counterclockwise rotation against the force of the spring 202. By this means angular adjustments of several degrees on either side of insertion direction of the press 10 may readily be achieved.

Left-right positioning of the side alignment stop is secured by a pair of vernier screws 214,216. These screws 214,216 are threadingly engaged with and passed through associated C clamps 210,220 placed on either side of the side alignment stop clamp 60. The C clamps 210,220 are respectively secured to the transverse bar 34 by set screws 222,224. With the clamps 218,220 secured on either side of the side alignment clamp 60, precise left and right positioning is secured by advancing or retracting the screws 214,216.

FIG. 16 shows the bleed valve assembly 86 affixed to the end of the suction member 70. As previously noted, the principal function of this valve is to permit a regulated amount of outside air to the interior of the suction member 70 so as to regulate the vacuum level therein during the vacuum shifting operating. FIG. 16 is a fragmentary view deleting central portions of the suction member 70, and showing only two lower air passages **72*a*,72*d*. The bleed valve assembly 86 comprises a valve housing 226 sealingly affixed to and in prolongation of the suction member 70. It is provided with an axially extending passage 228 threaded throughout a major portion of its length. A threaded valve stem 231 has a knob 233 at one end, and has and a central portion 235 threaded for engagement with the interior surface of the passage 228. Rotation of the stem 231 will cause it to enter deeper into the passage 228 or to retreat. An axial passage 239 is bored from the outer end 237 of the stem 231 to a point close to the knob 233. Entry of outside air into the suction element 70 around the stem 231 is prevented by an O-ring seal 240 at the outer end of the valve assembly. Regulated air bleed is provided by a hole 242 radially bored from the surface of the stem 231 and into communication with the passage 339. In the configuration shown in FIG. 16 the valve is completely sealed at its left hand end. If, however, the know 233 is rotated until the hole 242 passes leftwards of the O-ring 240, then outside air may enter the system. The amount may be varied by turning the knob 233** to chosen positions.

A further feature of selectively sealing off one of the passages **72*a*–72*d* is provided by a second O-ring seal 246 disposed in the passage 228. When the knob 233 is rotated for a full insertion, not only will the air bleed via the hole 242 be terminated, but also the outer end 237 of the valve stem 231 will be forced into engagement with the O-ring seal 246. This will block the left-most lower aperture 72*a*** so that suction is not delivered thereto. Thus the active number of apertures may also be selected by this means.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details.

What is claimed is:

1. Alignment apparatus for use with a printing press powered by a motor drive system and configured to print on rectangular sheets of printing stock having parallel top and bottom surfaces and to be moved in a first direction along a given feed path, said alignment apparatus comprising:

a side alignment stop for aligning a given side edge of a sheet transversely to said first direction;

a suction member having a sheet-engaging side with at least one suction aperture adapted for communication with a source of vacuum;

a motor-drivable first mounting system designed to support said suction member for cyclic driven motion towards and away from said side alignment stop, its direction of movement towards said stop having at least a component transverse to said first direction, said first mounting system positioning said sheet-engaging side of said suction member in confronting contact with one of said surfaces of said sheet to cause said suction member to adheringly move said sheet, said side alignment stop being in the path of movement of a sheet moved by said suction member to be engaged by said side edge of said sheet, and said motor-driven first mounting system losing driving engagement with said sheet after said side edge has engaged said side alignment stop.

2. The alignment apparatus of claim 1 in combination with said printing press, and wherein said first mounting system is coupled to be synchronously driven by said motor drive system.

3. The alignment apparatus of claim 1 wherein the suction supplied by said suction member is sufficiently low to permit said suction member to slide across said one of said surfaces without buckling said sheet after said given side edge has engaged said side alignment stop.

4. The alignment apparatus of claim 3 including an adjustable vacuum regulator controlling the level of vacuum applied to said suction aperture.

5. The alignment apparatus of claim 1 wherein said one of said surfaces of said sheet is the upper surface thereof.

6. The alignment apparatus of claim 5 for use with a printing press to include a support system designed to accept a plurality of said sheets of stock arranged as a vertically extending stack so that said one of said surfaces is the upper surface of the topmost sheet in said stack.

7. The alignment apparatus of claim 6 for use with a printing press to include a synchronously driven feed system for sequentially feeding side edge-aligned topmost sheets from said stack along said feed path and a terminal end registry stop disposed to engage and accurately align the front edges of sheets dispensed from said stack, and a front end rough alignment stop for said stack aligned transverse to said first direction, said alignment apparatus including a forward biasing system designed to urge at least said uppermost sheet towards said front end rough alignment stop.

8. The alignment apparatus of claim 7 for use with a printing press wherein said synchronously driven feed system includes at least one suction pickup element having a sheet-engaging portion with at least one suction aperture in communication with a source of vacuum and a second mounting system driven by said motor drive system configured to emplace said pickup element aperture against a leading portion of said topmost sheet after alignment against said side alignment stop and thereafter to raise said leading portion off of said stack by vacuum adhesion and to insert said leading portion into said feed path, and a suction control system for terminating suction to said pickup element upon insertion of said leading portion into said feed path.

9. The alignment apparatus of claim 8 for use with a printing press having an air supply system directing an airstream away from said front end rough alignment stop and towards the leading edge of said uppermost sheet to assist in separating said uppermost sheet from the sheet below it.

10. The alignment apparatus of claim 7 in combination with said printing press, and wherein said first mounting system is coupled to be synchronously driven by said motor drive system.

11. The alignment apparatus of claim 6 wherein said side alignment stop has a planar first surface confronting one edge of said stack, said stop surface having an planar offset second surface forming a step confronting said one edge of at least the topmost of said sheets and extending in said first direction so that when a plurality of underlying sheets of said stack are aligningly engaged by said first step surface, said topmost sheet is at a standoff distance from said second step surface, and including a side feed system disposed to urge said plurality of underlying sheets towards said first stop surface.

12. The alignment apparatus of claim 11 wherein said second mounting system is configured to permit rotation of said side alignment stop through a range of orientations to either side of said first direction, and includes a vernier drive for adjusting said angle to a chosen value.

13. The alignment apparatus of claim 6 wherein said side alignment stop includes a mounting apparatus configured to allow said side alignment stop to be emplaced over a range of positions on either side of said feed path, said side alignment stop being configured to align a sheet edge urged thereagainst from either direction transverse to said first direction.

14. The alignment apparatus of claim 13 wherein said first mounting system is adapted to be coupled to and be synchronously driven by said motor drive system and includes a mechanical stroke converter selectively operable to two conditions to reverse the phase of said reciprocating driven motion with respect to the timing of said suction control timer so that suction is removed from said suction member during notion of said suction member away from said side alignment stop according to which side of said feed path said side alignment stop occupies.

15. The alignment apparatus of claim 6 including a suction control timer synchronously coupled to said first mounting system, said suction control timer being configured to remove suction from said suction member during motion of said suction member away from said side alignment stop.

16. The alignment apparatus of claim 6 including a vernier adjustment for progressively laterally positioning said side alignment stop.

17. The alignment apparatus of claim 6 in combination with said printing press, and wherein said first mounting system is coupled to be synchronously driven by said motor drive system.

18. In an alignment apparatus for use with a printing press having a printing station, a sheet feeding system driven by a motor drive system for feeding sheets in a first direction along a given feed path to said station, a terminal registry end stop configured to accurately align the leading edge of rectangular printing stock having top and bottom faces and dispensed from a vertically extending stack of sheets to be engaged thereagainst, and an end pickup system driven by said motor drive system and having at least one suction conduit communicating with a source of vacuum and designed to engagingly adhere by suction a leading edge portion of an aligned uppermost sheet from said stack and transport said leading edge portion for subsequent engagement with said terminal registry end stop, said alignment apparatus comprising:

a side alignment stop for engagingly aligning one of the sides of said uppermost sheet along said feed path while on said stack;

a front end rough alignment stop for the front of said stack configured to allow a sheet to be slid towards said side alignment stop;

a suction member having a sheet-engaging side with at least one suction aperture adapted for communication with a source of vacuum;

a motor-driven first mounting system designed to support said suction member for cyclic driven motion towards and away from said side alignment stop in a direction transverse to said feed path, said first mounting system positioning said sheet-engaging side of said suction member in confronting contact with the top surface of said uppermost sheet to cause said suction member to adheringly move said sheet, said side alignment stop being in the path of movement of a sheet moved by said suction member to be engaged by said side edge of said sheet, said motor-drivable first mounting system losing driving engagement with said sheet after said side edge has engaged said side alignment stop; and a first timing system configured to terminate the application of vacuum to said suction member immediately before application of vacuum to said end pickup system.

19. The alignment apparatus of claim 18 in combination with said printing press, and wherein said first mounting system is coupled to be synchronously driven by said motor drive system.

20. An alignment apparatus for use in a printing press powered by a motor drive system and configured to print on rectangular sheets of printing stock having parallel major faces and movable in said press in a first direction along a feed path, said press including a support system for supporting a stack of sheets of said stock to be dispensed from the topmost sheet in said first direction and an alignment system for aligning a given side edge of a sheet along said first direction, said alignment apparatus comprising:

at least one side alignment stop for aligning said given side edge when said sheet is slid against said stop, said side stop having a planar first surface confronting one edge of said stack, said side stop surface having an planar offset second surface forming a step confronting said one edge of at least the topmost of said sheets and extending in said first direction so that when a plurality of underlying sheets of said stack are aligningly engaged by said first step surface, said topmost sheet is at a standoff distance from said second step surface;

a sheet engaging member configured to engage said top surface of said topmost sheet;

a motor-drivable system coupled to raise said sheet engaging member to move slide said topmost sheet into aligning contact with said second stop surface, and wherein said side alignment stop is mounted to permit rotation of said side alignment stop through a range of angular orientations to either side of said first direction, and there is provided a vernier drive for adjusting the orientation of a chosen value.

21. The alignment apparatus of claim 20 wherein said side alignment stop includes a second mounting system configured to emplace said side alignment stop over a range of .positions on either side of said feed path, said side alignment stop being configured to align a sheet edge urged thereagainst from either direction having a component transverse to said first direction.

22. The alignment apparatus of claim 21 including a vernier adjustment for positioning said side alignment stop along a given line parallel to paid first direction.

23. The alignment apparatus of claim 20 in combination with said printing press, and wherein said motor-drivable system is coupled to be synchronously driven by said motor drive system.

* * * * *